United States Patent [19]

Sorkilmo

[11] Patent Number: 4,951,982

[45] Date of Patent: Aug. 28, 1990

[54] DOOR LOCK SECURITY APPARATUS

[76] Inventor: Clayton O. Sorkilmo, 72nd Cir. North, Brooklyn Center, Minn. 55429

[21] Appl. No.: 382,910

[22] Filed: Jul. 21, 1989

[51] Int. Cl.[5] ..... E05C 17/54

[52] U.S. Cl. ..... 292/343; 292/258

[58] Field of Search ..... 292/258, 288, 212, 342, 292/343; 70/416

[56] References Cited

U.S. PATENT DOCUMENTS

| | | | |
|---|---|---|---|
| 564,294 | 7/1896 | Shepard et al. | 292/67 |
| 776,378 | 11/1904 | Bellamy | 292/343 |
| 1,119,650 | 12/1914 | Smith | 292/343 |
| 1,338,205 | 4/1920 | Albright | 292/343 |
| 2,396,982 | 3/1946 | Bousquet | 292/258 X |
| 4,715,200 | 12/1987 | Katsonas | 70/416 X |

*Primary Examiner*—Richard E. Moore
*Attorney, Agent, or Firm*—Clayton R. Johnson

[57] ABSTRACT

For maintaining a dead bolt lock handle in a locked position while the occupant of a room is inside of the room to prevent someone outside of the room unlocking the dead bolt lock, there is provided an elongated security member having a first end portion that mounts an adjustment member and a second end portion that is notched to have lock handle extend therethrough and form two legs. The adjustment member in abutting against the door serves to vary the angle of the legs relative to the door to wedgingly engage the cross bar in its locked position to prevent one exterior of the room using a key to unlock the lock. The second end portion may be directly abuttable against one of the lock housing and the door, or if necessary a spacer plate may be used to have extend between the security member and the door interior. The spacer plate has notches for the adjustment member and the lock handle to extend through.

12 Claims, 1 Drawing Sheet

FIG. 1
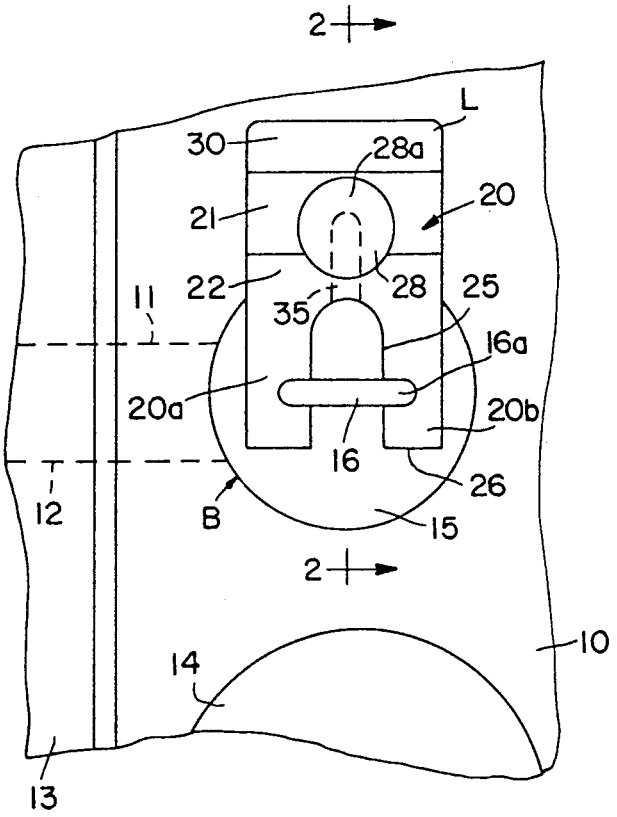
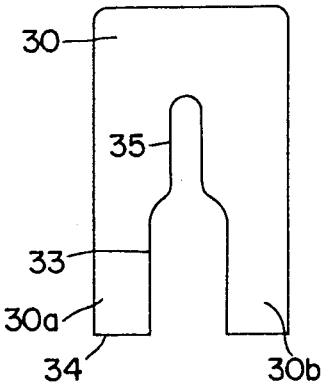
FIG. 3
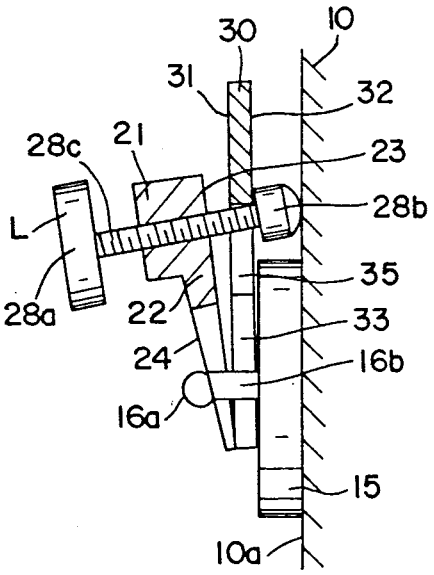
FIG. 2
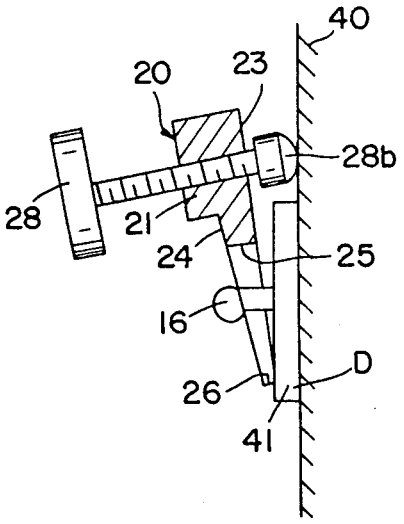
FIG. 4

DOOR LOCK SECURITY APPARATUS

BACKGROUND OF THE INVENTION

Security mechanism for preventing a dead bolt lock being unlocked from outside of the room.

In many places, for example, hotel rooms, there is provided dead bolt locks for purposes of preventing parties from entering the room while the occupant is in the room However usually the door can be unlocked from the outside by a master key which may be used by dishonest employees or other persons.

In No. 4,279,137 to Cook there is disclosed security mechanism that includes a plate having a downwardly opening notch to have the door handle extend therethrough and an elongated notch to have the dead bolt lock handle extend therethrough. Struts are mounted by the plate to prevent the lock handle being turned by one using a key outside of the door when the door handle extends through the notch. Dominguez, No. 3,585,827, functions in a manner somewhat similar to that disclosed by Cook.

In No. 3,263,462 to Suroff et al there is disclosed a locking device that includes a lock having a generally rectangular lock block located inside a room and a lock actuator within the room that is turned when using a key outside of the room. A somewhat U-shaped base has a lower leg to abut against the block lower edge, a second leg adapted to abut against the upper edge of the block, a pair of adjustment screws mounted by the second leg and adapted to be turned for adjusting the spacing of the second leg from the block, and a recess for receiving the lock actuator therein to prevent the lock actuator rotating when it is attempted to unlock the door from outside of the room. One of the limitations of this type apparatus is that if the lock does not have a rectangular block extending into the room the apparatus can not be used in a manner suggested by this patent.

Anderson No. 689,152 disclosed a plate having a curved portion that is inclined at an angle to limit the degree of opening of a door. A screw is threaded into the plate and has its lower end mounting a foot to abut against the floor. By turning the screw the angle of plate relative to the floor can be increased above that provided by the curved portion.

In order to provide improvements in devices such as disclosed in the above mentioned patents this invention has been made.

SUMMARY OF THE INVENTION

The invention disclosed herein includes security member legs adapted to be located on opposite sides of the shaft portion of a dead bolt lock handle that extends into the room and a tapered surface for abutting against the finger operated portion of the lock handle when an adjustment member that abuts against the door is operated to sufficiently incline the tapered surface to prevent the dead bolt lock handle being rotated. The adjustment member is spaced from the legs which abut against one of the dead bolt lock cylinder; and a spacer plate that may be sandwiched between the cylinder and the security member, depending upon whether or not the security member can be sufficiently inclined to block rotation of the dead bolt handle without the use of the spacer plate. The spacer plate has spaced legs to provide a notch to have the dead bolt handle extend therethrough.

One of the objects of this invention is to provide new and novel security lock means that is compact, cheap to manufacturer and prevent unlocking a dead bolt lock from outside the room while not relying on coaction with a door handle or a rectangular shaped lock block.

FIG. 1 is a fragmentary front view of a door frame and door adjacent the door handle and dead bolt lock together with the first embodiment of the door lock security apparatus of this invention in a use for preventing the dead bolt lock being unlocked from outside of the room:

FIG. 2 is a vertical cross sectional view of the embodiment of FIG. 1 and the adjacent part of the dead bolt lock and door, said view being generally taken along the line and in the direction of the arrows 2—2 of FIG. 1;

FIG. 3 is a front view of the spacer plate of the first embodiment; and

FIG. 4 is a cross sectional view similar to that of FIG. 2 other than it is illustrates the use without the spacer plate, but with a dead bolt lock of a somewhat different construction from that shown in FIG. 1.

Referring now to FIGS. 1 through 3, the first embodiment of the security lock apparatus of this invention, generally designated L, is used for preventing the unlocking a dead bolt lock, generally designated B, from outside of the room. The dead bolt lock B mounted by a door and has a dead bolt 11 extendable into a well 12 formed in the door frame 13 of the room. The dead bolt lock also includes a lock cylinder or housing 15 mounted by the door, usually adjacent to the door handle 14, but spaced therefrom. The housing frequently, but not always, extends away from the adjacent part of the door and further into the room than the adjacent door panel when the door is closed.

The housing mounts conventional mechanism (not shown) that is operated by the dead bolt handle lock actuator or operator handle) 16 that extends into the room and is mounted by the housing. The dead bolt handle frequently has a generally horizontal shaft portion **16*b* and a cross bar portion 16*a* that mounts portion 16*b* in spaced relationship to the door. Even though portion 16*b* has been referred to as a cross bar, it is to be understood that it may be of other shapes, for example, generally of a disk shape that is of a larger diameter than the shaft portion. Also the distance that the cross bar portion is spaced from the door and the distance that the housing extends away from the door, if any, varies, depending upon the make of lock, or may not be exposed through door surface 10*a***.

The security lock apparatus L includes a security member, generally designated 20, having a block portion 21 and a plate portion 22 joined to the block portion to extend away therefrom and advantageously of a maximum thickness of less than about half of the block portion. The plate and block portions are joined to form a continuous planar door facing surface 23. Opposite of surface 23, the plate portion 22 has a tapered surface 24 that intersects with the block portion, extends a shorter distance away from the surface 23 than the block portion extends away from the surface 23 and converges toward the surface 23 in a direction away from the block portion. The plate portion has a generally U-shaped notch 25 that opens to the transverse edge 26 of the plate portion that is opposite of the block portion and through the surfaces 23, 24 to form elongated legs **20*a*, 20*b* that are spaced sufficiently to have the shaft portion of dead bolt handle extend therethrough, but less than the maximum dimension of portion 16***b* that extends transverse to the shaft. Advantageously, as in part may be seen from FIG. 1, even if the shaft portion of the dead bolt handle were in abutting relationship to the web portion of the wall defining notch 25, legs 20*a*, 20*b* are not of sufficient length to abut against the door knob. The length of the plate portion is substantially greater than the corresponding dimension of the notch and is substantially greater than the dimension at right angles thereto, i.e. width of each of the surfaces 23, 24.

In order to adjustably vary the angle of the tapered surface 24 relative to the inside surface 10*a* of the door, an adjustment member 28 is mounted by the block portion to extend through the planar surface 23 at right angles thereto The adjustment member includes a threaded shaft portion 28*c*, a rounded rubber tipped foot 28*b* joined to one end of the shaft portion for bearing against the door surface 10*a* and knurled knob 28*a* joined to the opposite end of the shaft portion that is opposite the block portion from the foot for selectively varying the distance the spacing of the foot from the planar surface 23.

In situations where the angle of the tapped surface can not be operatively vary to a large enough angle to effectuate the use of this invention as desired, there is provided one or more spacer plates 30. The spacer plate advantageously may be rectangular and of a greater length than security member. The spacer plate has opposite parallel planar surfaces 31, 32 and a terminal transverse edge 34. A generally U-shaped notch 33 is provided in the plate to open through surfaces 31, 32 and edge 34 while a second notch 35 is provided to open to the web portion of the notch 33, i.e. opposite from the edge 34. Advantageously notch 33 is of the same size and shape as notch 25, but of a substantially greater transverse width than the notch 35. Notch 35 is of a transverse width to have the adjustment member shaft 28*c* extended therethrough while each of notches 33, 25 are of transverse widths to have dead bolt handle portion 16*b* extended therethrough. Advantageously the notches 25, 33 and 35 are transversely centered in the member in which they are respectively formed.

In using the first embodiment the spacer member is positioned to have the adjustment member shaft extended through the notch 35 and the with the dead bolt handle and dead bolted in their locked positions, the combination of the spacer plate and security member are moved downwardly to have the dead bolt handle shaft portion 16*b* extended through the notches 25, 33. Now the adjustment member is rotated to have the foot bear against the door and move the block portion away from the door to increase the angle of the tapered surface relative to the door until the tapered surface abuts against the cross bar portion 16*a* in binding engagement therewith to prevent rotation of the dead bolt handle portion by one turning a key outside of the room in an attempt to obtain access to the room. The spacing of the web portions of the notches from the shaft portion 16*b* depends in part upon the distance that the lock housing extends away from the door surface, if any, the diameter of the housing, the spacing of the cross bar portion 16*a* from the housing, and the angle of taper and thickness of the tapered portion. Advantageously the angle of taper of the tapered portion the surface 23 is about 5–15°.

During use, preferably the block portion is located above the dead bolt handle whereby gravitatiOn forces would tend to increase the wedging action of the tapered surface against the cross bar. The tapered surface portion of one of the legs 20*a* and 20*b* would exert a greater wedging if the dead bolt handle would tend to rotate in one direction while the other leg would similarly function if the handle tended to rotate in the opposite direction.

To remove the security member the adjustment member is rotated in a direction to release the binding action of the tapered portion against the dead bolt lock handle cross member. Thence the security member and spacer plate are move away from the dead bolt lock.

In the event the dimensions of the dead bolt lock are such that a spacer plate is not required, for example with the dead bolt lock D of FIG. 4, the security apparatus of the first embodiment is used such as shown in FIG. 4. The dead bolt lock D includes a cylinder 41 that does not extend away from the door 40 as far as does the cylinder 15 and a dead bolt handle 42 having its cross bar portion more closely adjacent to the lock cylinder then the spacing of the cross bar 16*a* from the cylinder 15. The manner of use of this invention with reference to FIG. 4 is the same as described with reference to FIGS. 1–3 other than the tapered portion bears against the lock cylinder, and the spacer plate is not inserted between the security member and lock housing or the door surface 10*a*.

In the event that the dead bolt lock is of a type that the lock housing does not extend through the door surface 10*a*, than during use, either the tapered portion, or the spacer plate, if used, bear directly against the door surface. If the angle of taper of the tapered portion is to great than the desired wedging action can not be obtained; while if portion 25 were not tapered, a greater number of spacer plates would be required and it would not be as easy to use the invention with as may variations of dead bolt lock assemblies as is the situation with the tapered surface being provided.

Instead of surface 23 being perpendicular to the axis of shaft 28*c*, surfaces 24 may be perpendicular to the shaft and surface 23 tapered to converge toward surface 24 in a longitudinal direction toward edge 26.

What is claimed is:

1. In combination with a door, the door having an interior surface, a door knob mounted by the door and extending inwardly of the interior surface and a dead bolt lock mounted by the door and having a lock housing mounted by the door, a dead bolt handle rotatably mounted by the housing and having a shaft portion extending away from the door interior surface and a cross bar portion that is of a larger transverse dimension than the shaft portion and joined to the shaft portion remote from the interior surface, and a longitudinally elongated security member removably mounted on the door and at least in part by the dead bolt lock, the security member having a first surface, a first longitudinal end portion having at least part of the first surface, and a second end portion joined to the first end portion to extend longitudinally away therefrom, the second end portion having a second surface opposite from the first surface for abutting against the cross bar portion, the second end portion having a first transverse terminal edge longitudinally opposite of the first end portion and a notch opening through said surfaces and to the transverse edge for having the dead bolt handle shaft portion extended therethrough and first means for abutting against at least one of the door interior and the lock housing to selectively vary the spacing of the first end portion surface part from the door surface and moving the second surface into wedging relationship to the cross bar to prevent rotation of the dead bolt lock handle, the first means including foot means for abutting against one of the door interior and the lock housing, the foot means including a foot, and an adjustment member mounted by the first end portion and joined to the foot for selectively varying the spacing of the foot from the first end portion and thereby vary the angle of the second end portion relative to the door surface sufficiently to bindingly engage the cross bar portion when the dead bolt handle extends through the notch.

2. The apparatus of claim 1 further characterized in that the second end portion has a part of the first surface, the second surface and the second end portion surface part converging in a direction toward the transverse edge.

3. The apparatus of claim 1 further characterized in that the second end portion has at least part of the first surface and that the maximum thickness dimension of the second end portion between the first surface and second surface is substantially less than the corresponding dimension of the first end portion.

4. The apparatus of claim 1 further characterized in that the first surface extends the longitudinal length of the first and second end portions and is substantially planar, that the second surface is substantially planar and that the first and second surfaces longitudinally converge in a direction towards the transverse edge.

5. The apparatus of claim 4 further characterized in that the maximum thickness dimension of the second end portion is less than about half of the corresponding dimension of the first end portion.

6. The apparatus of claim 5 further characterized in that the adjustment member comprises a shaft portion threadedly mounted by the first end portion and is joined to the foot for moving the foot away from and toward the first surface as the shaft portion is threadingly moved relative to the first end portion and that the longitudinal length of the second end portion is many times greater than the maximum thickness dimension of the second end portion and is less than necessary to extend into abutting relationship to the door knob.

7. Door lock security apparatus for a door having an interior surface and that mounts a door knob, and a security lock mounted by the door and having a lock housing and a lock operator handle mounted by the housing and having a shaft portion extending away from the door interior surface and a cross bar portion that has a larger transverse dimension than a corresponding dimension of the shaft portion, is joined to the shaft portion remote from the interior surface and is rotatable between an unlocked and a locked position, comprising a longitudinally elongated security member having a first longitudinal end portion, a second longitudinal end portion joined to the first end portion to extend longitudinally away therefrom, the first and second end portions having a generally planar, coextensive first surface extending the longitudinally length of the first and second end portions, the second end portion having a terminal transverse edge remote from the juncture of the first and second end portions and a second surface opposite of the first surface, the second end portion having a maximum thickness dimension between said surfaces that is less than the corresponding dimension of the first end portion and a longitudinally elongated notch of a transverse dimension to have the lock shaft extend therethrough and less than the maximum transverse dimension of the cross bar in its locked position, is transversely centered and opens through said surfaces and the transverse edge to form two transversely spaced longitudinally elongated legs that are extendable between the cross bar in its locked position and at least one of the door interior surface and the lock housing and an adjustment member having a foot adapted to be located between the first end portion and the door interior surface and the first surface, a shaft portion threadedly mounted by the first end portion and joined to the foot for selectively varying the distance that the foot extends away from the first end portion and thereby vary the angle of the second surface relative to the door interior surface when the cross bar in its locked position extends through the notch and a knob joined to the adjustment member shaft on the opposite of the first end portion from the first surface for rotating the adjustment member shaft.

8. The apparatus of claim 7 further characterized in that the first and second surfaces converge in a longitudinal direction toward the transverse edge and that the longitudinal length of the notch is less than the spacing of the shaft portion from the door knob.

9. Door lock security apparatus for a door having an interior surface and that mounts a door knob and a dead bolt lock mounted by the door and having a lock housing mounted by the door and a dead bolt handle rotatably mounted by the housing and having a shaft portion extending away from the door interior surface and a cross bar portion that is of a larger transverse dimension than the shaft portion and joined to the shaft portion remote from the interior surface, comprising a longitudinally elongated security member having a first surface, a first longitudinal end portion having at least part of the first surface, and a second end portion joined to the first end portion to extend longitudinally away therefrom, the second end portion having a second surface opposite from the first surface that is adapted for abutting against the cross bar portion, the second end portion having a first transverse terminal edge longitudinally opposite of the first end portion and a notch opening through said surfaces and to the transverse edge for having the dead bolt handle shaft portion extended therethrough and first means for abutting against at least one of the door interior and the lock housing to selectively vary the spacing of the first end portion surface part from the door surface and moving the second surface into wedging relationship to the cross bar to prevent rotation of the dead bolt lock handle, the first means including a foot for abutting against one of the door interior and the lock housing and an adjustment member mounted by the first end portion and joined to the foot for selectively varying the spacing of the foot from the first end portion and thereby vary the angle of the second end portion relative to the door surface when the dead bolt handle extends through the notch, the first means comprising spacer means insertable between the first surface, including the second part, and the door surface to maintain a preselected minimum spacing of the second end portion from the door interior surface and the lock housing when extending between the second end portion and the door and the lock housing and the dead bolt handle extends through the notch.

10. The apparatus of claim 9 further characterized in that the spacer means comprises a longitudinally elongated plate having opposite surfaces, a transverse terminal edge and a notch opening through the plate surfaces and the plate transverse edge for having the dead bolt handle extend therethrough while in abutting relationship to at least one of the door interior surface and the lock housing.

11. The apparatus of claim 10 further characterized in that the first plate notch is of a longitudinal length that is about the same as the corresponding dimension of the second portion notch, and that the plate has a second plate notch opening to the plate first notch longitudinally opposite the plate transverse edge and extends longitudinally away therefrom to have the adjustment member extend therethrough when the dead bolt lock handle extends through the plate first notch.

12. The apparatus of claim 11 further characterized in that the plate second notch maximum transverse dimension is less than the corresponding maximum transverse dimension of the plate first notch and that the security member first surface and the plate surfaces are planar, the thickness of the plate being many time less than the transverse and longitudinal dimensions of the plate.

* * * * *